US005402898A

United States Patent [19]

Lute

[11] Patent Number: 5,402,898

[45] Date of Patent: Apr. 4, 1995

[54] CRANE HAVING BOOM REST

[75] Inventor: Gerald E. Lute, Mercersburg, Pa.

[73] Assignee: JLG Industries, Inc., McConnellsburg, Pa.

[21] Appl. No.: 915,644

[22] Filed: Jul. 21, 1992

[51] Int. Cl.[6] ..... B66C 23/06; B66C 23/62

[52] U.S. Cl. ..... 212/255; 212/175; 212/229; 212/232; 212/261

[58] Field of Search ..... 212/255, 175, 179, 180, 212/182, 188, 208, 261, 211, 227, 229, 231, 232, 244, 146

[56] References Cited

U.S. PATENT DOCUMENTS

| | | | |
|---|---|---|---|
| 1,751,794 | 3/1930 | Crandall | 212/264 |
| 1,800,379 | 4/1931 | Davis . | |
| 3,545,628 | 12/1970 | Dechanstsreker | 212/124 |
| 3,648,956 | 3/1972 | Paulson et al. | 248/2 |
| 3,664,515 | 5/1972 | Orendorff et al. . | |
| 3,792,778 | 2/1974 | Sholl et al. . | |
| 3,964,614 | 6/1976 | Welch . | |
| 4,039,093 | 8/1977 | Schmitz, Jr. et al. . | |
| 4,189,278 | 2/1980 | Dewey | 414/713 |
| 4,411,070 | 10/1983 | Boyum et al. | 212/264 |
| 4,579,235 | 4/1986 | Orwig | 212/182 |
| 4,856,662 | 8/1989 | Marvin et al. | 212/176 |
| 4,982,853 | 1/1991 | Kishi | 212/231 |
| 5,054,990 | 10/1991 | Schaeff | 414/694 |
| 5,211,297 | 5/1993 | Vandervalk | 212/182 |

FOREIGN PATENT DOCUMENTS

| | | |
|---|---|---|
| 2228857 | 1/1974 | Germany . |
| 2097752 | 11/1982 | United Kingdom . |
| 2103574 | 2/1983 | United Kingdom . |
| 965976 | 10/1982 | U.S.S.R. . |
| 1212925 | 2/1986 | U.S.S.R. . |
| 1404446 | 6/1988 | U.S.S.R. . |

*Primary Examiner*—Michael S. Huppert
*Assistant Examiner*—R. B. Johnson
*Attorney, Agent, or Firm*—Foley & Lardner

[57] ABSTRACT

A truck mounted crane assembly includes a turntable lock, a boom rest which interacts with the piston and cylinder device, and a swing away hoist mount. The turntable lock includes a pin which is manually retractable upon rotation of a handle from a position preventing relative rotation between a turntable and a pedestal to a position allowing such relative rotation and which can be secured in the first and second positions. The boom rest is mounted on the boom and rests on the cylinder of the piston and cylinder device when the boom is lowered to a predetermined position, thus taking much of the pressure off the piston. The boom rest is movable from a position in which it is capable of supporting the boom to a position in which it is incapable of supporting the boom and in which the boom is thus lowerable below the predetermined position. The provision of the turntable lock and boom rest obviates the need for a cradle rest for the boom. Finally, the hoist mount receives the hoist, is connected to the boom, and is movable under actuation of the hoist or telescoping of the end of the boom from a first, working position to a second position allowing access to the interior of the front end of the boom.

7 Claims, 4 Drawing Sheets

CRANE HAVING BOOM REST

BACKGROUND OF THE INVENTION

The present invention relates to crane assemblies and, more particularly, relates to crane assemblies which are mounted on trucks or other movable platforms and which have a vertically pivotable boom mounted on a rotatable turntable and a cable hoist assembly mounted on the boom.

So-called boom truck cranes are well known. Referring to FIG. 8, a conventional assembly typically includes a pedestal 220 mounted on or proximate the bed 202 of a truck 204. A turntable assembly 230 is mounted on the pedestal 220, and a boom 280 and a hydraulic piston and cylinder device 300 are mounted on the turntable assembly 230. A hoist 250 is mounted on the lower or front end of the boom 280 and is actuatable to raise and lower a hook block or down haul weight 320 by winding and unwinding a cable from a drum provided on the hoist 250. An A-frame cradle or other similar boom rest 330 is provided on the rear end of the truck bed 202 and receives the boom 280 when the boom is lowered to the horizontal position, thus storing the boom for transport of the crane assembly.

The turntable assemblies, hoist mount assemblies, and boom rests of conventional truck mounted boom assemblies, though satisfactory, exhibit several drawbacks and disadvantages.

First, turntables of such assemblies must be rotatably driven by drive systems including motors, gear trains, brakes, etc. In order to prevent externally induced rotation which could otherwise occur during transport of the vehicles and which could overload such drive systems and damage this machinery, the turntable assemblies must be mechanically locked from rotation. The typical boom assembly of the type illustrated in FIG. 8 provides this locking by providing a cradle-type boom rest 330 of the type described above. Rotation of the turntable is prevented during vehicle transport by supporting much of the weight of the boom 280 on the boom rest 330, thus providing sufficient resistance to torque to prevent unintended rotation of the turntable assembly 230 with respect to the pedestal 220. While this arrangement is functionally adequate to prevent rotation, the provision of the cradle 330 on the truck bed 202 significantly reduces the utility of the truck bed for cargo carrying purposes. In addition, actuation of the piston and cylinder device 300 and lifting of the boom 280 from the cradle 330 is required to allow for rotation of the turntable assembly 230.

Other devices have been proposed to lock a turntable assembly of a truck mounted crane assembly from rotation without resting the boom on a cradle or other support located remote from the turntable. One such device is disclosed in U.S. Pat. No. 3,648,956, which issued to Loree A. D. Paulson on Mar. 14, 1972. Pursuant to this design, a pin is provided which extends through the side of the turntable and which is insertable into an aperture located in the boom support assembly. A handle is attached to the end of the pin which protrudes from the turntable. When the handle is manually moved away from the boom support assembly, the pin is withdrawn from the support assembly and thus allows rotation of the turntable with respect to the support assembly.

While this arrangement has the advantage of locking a turntable without requiring a cradle assembly for supporting the boom, it still exhibits several disadvantages. Most notably, the handle and pin must be manually withdrawn, without the aid of any other mechanical device, by pulling the handle away from the turntable support. This requires substantial manual effort and may inhibit unlocking of the pin if substantial residual forces are imposed on the pin by the boom mount assembly. Moreover, no means are provided for maintaining the handle and pin in their withdrawn positions, thus requiring the operator to hold the handle in its retracted position while the turntable is rotated.

As discussed above, the cradle assembly associated with conventional truck mounted boom assemblies has the disadvantage of limiting the cargo carrying capacity of the truck on which the crane is mounted. However, even if some other device were to be provided to lock the turntable to the pedestal of such an assembly, the cradle still could not be removed since the boom itself still would have to be stowed for transport. More specifically, referring again to FIG. 8, a crane boom 280 must be supported during transport to prevent damaging pressures from being induced in the hydraulic lift cylinder of the piston and cylinder device 300 caused by internal forces of the boom as the truck 204 travels over various terrain. To avoid these damaging forces, at least some of the weight of the boom must be taken off from the piston of the piston and cylinder device 300. This is accomplished in the conventional device by supporting the free end of the boom 280 on the cradle type device 330 discussed above. Thus, the cradle device cannot be removed in conventional assemblies without risking damage to the piston and cylinder device used to raise and lower the boom.

Proposals have been made to eliminate the conventional cradle-type boom rest assembly by providing a structure which supports the boom for transport and which is not directly supported on the bed of the truck. For instance, in U.S. Pat. No. 4,579,235, which issued to Herbert L. Orwig on Apr. 1, 1986, a boom rest device has been proposed which comprises a pair of arms which extend generally in the same direction as the piston and cylinder device, which are connected at first ends thereof to the boom, and which have second ends which are connectable to the pedestal or pedestal mount assembly to support the boom for transport.

While the boom rest disclosed by Orwig does eliminate the need for the provision of a cradle on a truck bed, it still exhibits several disadvantages. Most notably, for connection of the arms to the base member, the arms must be lowered to a predetermined position and maintained in that position while the boom is lowered to a position in which the arms engage mounting bosses on the pedestal. This positioning is accomplished in Orwig by the provision of chains which hold the arms in the proper orientation for lowering. However, these chains are subject to breakage or kinks which could prevent adequate mating of the arms to the bosses which they engage. This problem is compounded by the fact that the two arms act independently of one another, thus doubling the chances of complications.

Another disadvantage associated with the conventional truck mounted boom assembly is the manner by which the hoist is mounted on the end of the boom. Referring again to FIG. 8, the typical hoist 250 is bolted directly to the end of the boom 280 via fixed mounting flanges. To expose the internal workings of the rear end of the boom 280 for adjustment, inspection, or maintenance, the hoist 250 must be unbolted from the mounting flanges and removed. Since the hoist weighs several hundred pounds, an external lifting apparatus such as another crane must be employed to remove the hoist and to lift it back into position for reattachment. Even then, considerable manual effort is required to properly position the hoist for reattachment to the boom.

OBJECTS AND SUMMARY OF THE INVENTION

It is therefore an object of the invention to quickly, easily, and assuredly lock a rotatable turntable of a truck mounted boom assembly to the accompanying pedestal to prevent overloading of the internal workings of the turntable drive assembly during transport of the assembly.

In accordance with a first aspect of the invention, this object is achieved by providing a crane comprising a base, a turntable which is rotatably mounted on the base, and a lock device for selectively locking the turntable from rotating with respect to the base. The lock device includes a pin extendible through the turntable and into a hole formed in the base, a surface which is located proximate the pin and which is ramped with respect to the turntable, and a handle which is affixed to the pin and which engages the ramped surface. The handle is rotatable from a first position in which the pin engages the pedestal top plate and a second position in which the pin is completely disengaged from the pedestal top plate. The ramped surface has devices provided thereon for maintaining the handle in the first and second positions.

Another object of the invention is to provide a boom rest for a truck mounted boom assembly which does not reduce with the cargo carrying area of a truck on which the assembly is mounted and which can be easily, quickly, and assuredly placed in the boom storage position.

In accordance with another aspect of the invention, this object is achieved by providing a crane comprising a base, a boom which is attached to the base and which is vertically pivotable with respect to the base, a lift cylinder, and a piston having a first end which is slidably received in the lift cylinder and a second end which is connected to the boom. The piston is actuatable to raise and lower the boom with respect to the base. A boom rest is also provided which is attached to the boom and, when the boom is in a predetermined position, extends generally in parallel with the lift cylinder, rests on the lift cylinder, and supports the boom.

It is yet another object of the invention to provide a mounting assembly for quickly and easily attaching a hoist to a boom and for allowing the assembly to be moved to allow access to the internal components of the boom without the imposition of external lifting devices.

In accordance with another aspect of the invention, this object is achieved by providing a crane comprising a boom, a hoist, and a mounting assembly which is fixedly attached to the hoist and which is movably connected to an end of the boom. The mounting assembly and the hoist are movable from a working position to a position which allows access to the end of said boom.

Still another object of the invention is to eliminate the need for the cradle-type boom rest associated with conventional truck mounted crane assemblies, thus increasing the storage area of the trucks on which the cranes are mounted.

In accordance with yet another aspect of the invention, this object is achieved by providing a crane comprising a base, a turntable which is rotatably mounted on the base, a boom which is attached to the turntable and which is vertically pivotable with respect to the turntable, and a lock device for selectively locking the turntable from rotating with respect to the base. The lock device includes a pin extendible through the turntable and into the base. Also provided are a lift cylinder and a piston having a first end which is slidably received in the lift cylinder and a second end which is connected to the boom. The piston is actuatable to raise and lower the boom with respect to the base. A boom rest is attached to the boom and, when the boom is in a predetermined position, rests on the lift cylinder and supports the boom.

Other objects, features and advantages of the present invention will become apparent to those skilled in the art from the following detailed description. It should be understood, however, that the detailed description and specific examples, while indicating preferred embodiments of the present invention, are given by way of illustration and not limitation. Many changes and modifications within the scope of the present invention may be made without departing from the spirit thereof, and the invention includes all such modifications.

BRIEF DESCRIPTION OF THE DRAWINGS

The above and further objects of the invention will become more readily apparent as the invention is more clearly understood from the detailed description to follow, reference being had to the accompanying drawings in which like reference numerals represent like parts throughout, and in which.

DETAILED DESCRIPTION OF THE PREFERRED EMBODIMENTS

Pursuant to the present invention, a truck mounted crane assembly is provided having a turntable lock, a boom rest which interacts with the piston and cylinder device, and a swing away hoist mount. The turntable lock includes a pin which is manually retractable upon rotation of a handle from a position preventing relative rotation between a turntable and a pedestal to a position allowing such relative rotation and which can be secured in the first and second positions. The boom rest is mounted on the boom and rests on the cylinder of the piston and cylinder device when the boom is lowered to a predetermined position, thus taking much of the pressure off the piston. The boom rest is movable from a position in which it is capable of supporting the boom to a position in which it is incapable of supporting the boom and in which the boom is thus lowerable below the predetermined position. The provision of the turntable lock and boom rest obviates the need for a cradle rest for the boom. Finally, the hoist mount receives the hoist, is connected to the boom, and is movable under actuation of the hoist from a first, working position to a second position allowing access to the interior of the front end of the boom.

Figure 1:
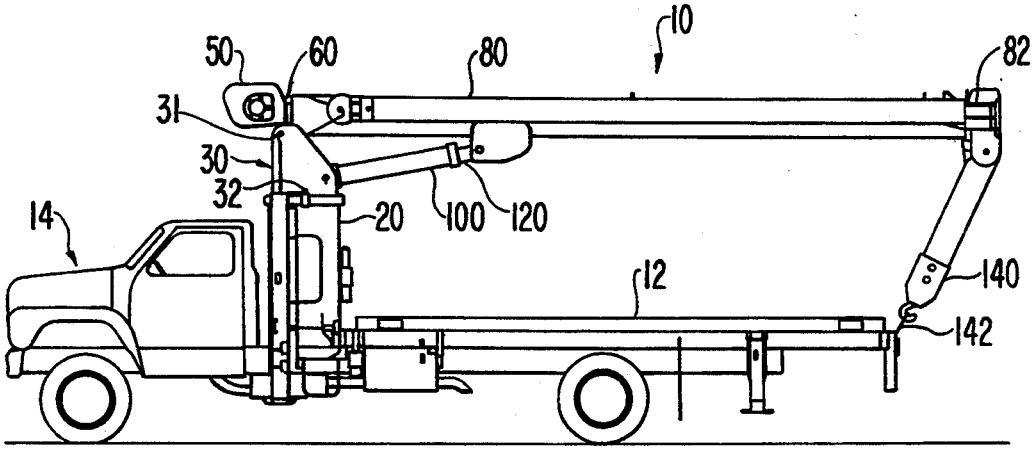
FIG. 1 is an elevation view of a truck and truck mounted crane assembly constructed in accordance with a preferred embodiment of the invention.
Figure 8:
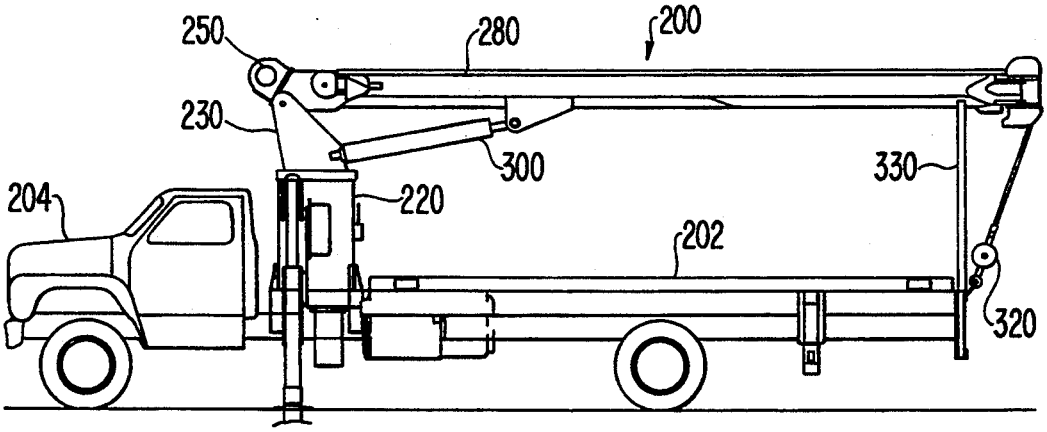
FIG. 8 (PRIOR ART)
FIG. 8 is an elevation view of a conventional truck and truck mounted crane assembly, appropriately labelled "Prior Art".

Referring to FIG. 1, a crane assembly 10 is mounted proximate the bed 12 of a truck 14. The crane assembly 10 includes a pedestal 20, a turntable assembly 30, and a hoist 50 connected to a telescoping boom 80 via a hoist mount assembly 60. The boom 80 is pivotable about a pivot point 31 of turntable assembly 30 and is raised and lowered by a piston and cylinder device 100. The end 82 of the boom is telescopically received in the remainder of the boom and is retracted into and extended from the remainder of the boom under actuation of a telescoping cylinder (not shown) in a manner which is, per se, well known. In FIG. 1, the boom 80 is illustrated in a position in which it is nearly but not completely retracted. A boom rest 120 supports the boom 80 when the boom is lowered to the horizontal position illustrated in FIG. 1. The hoist 50 deploys cable in a manner which is, per se, well known to raise and lower a hook block or down haul weight 140.

Figure 2:
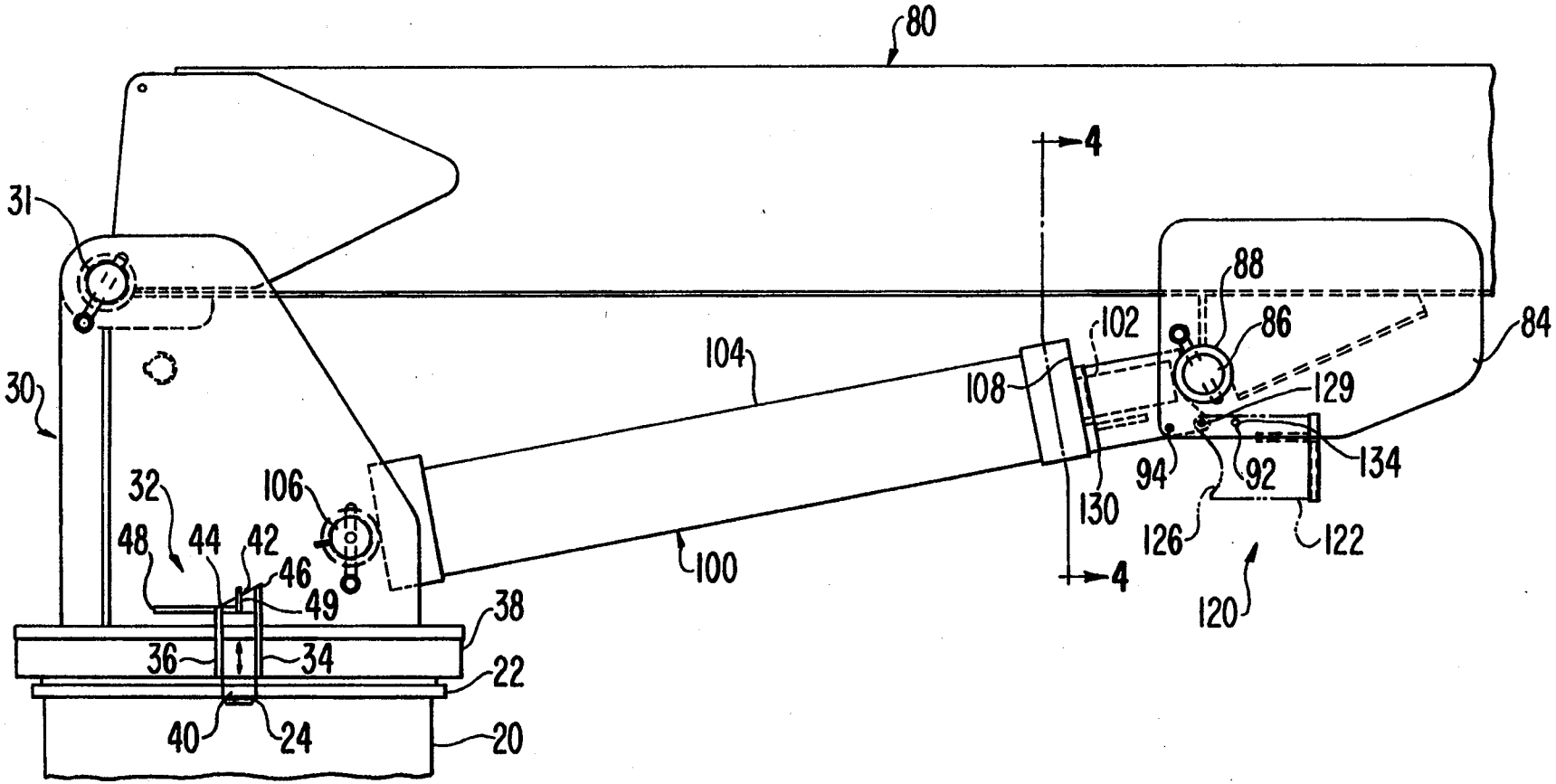
FIG. 2 is an elevation view of a portion of the crane assembly of FIG. 1.
Figure 3:
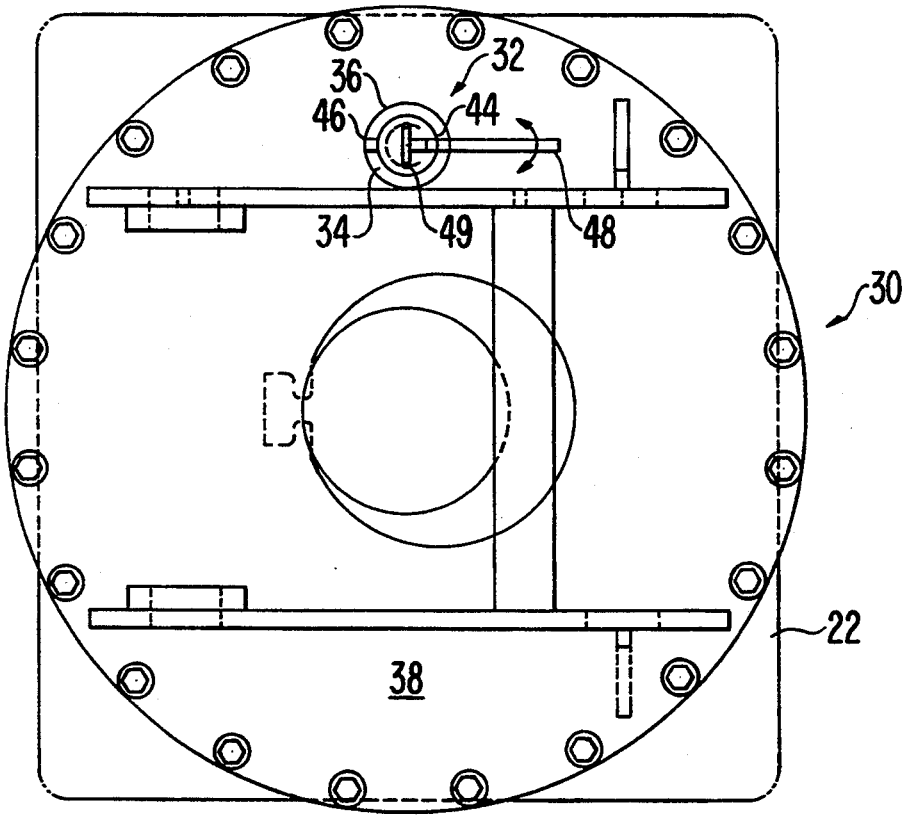
FIG. 3 is a plan view of the turntable assembly of FIG. 1.
Figure 5:
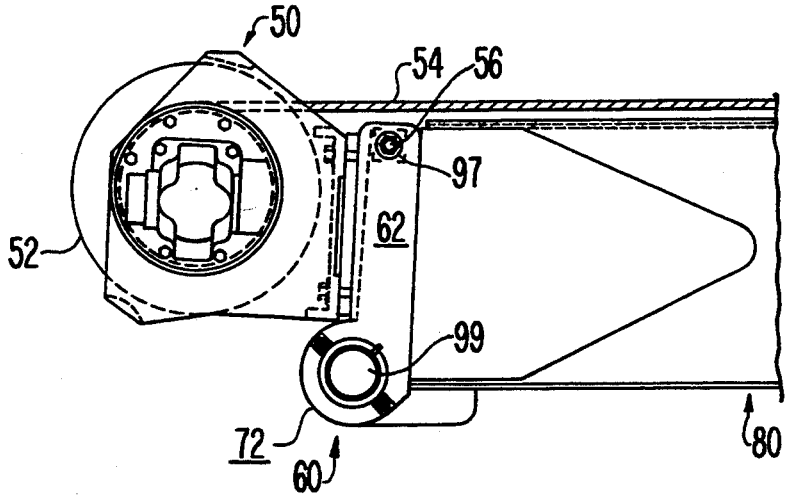
FIG. 5 is an elevation view of the hoist and hoist mount assembly of the truck mounted crane assembly of FIG. 1 with the hoist and hoist mount assembly being positioned in their normal operating positions.
Figure 6:
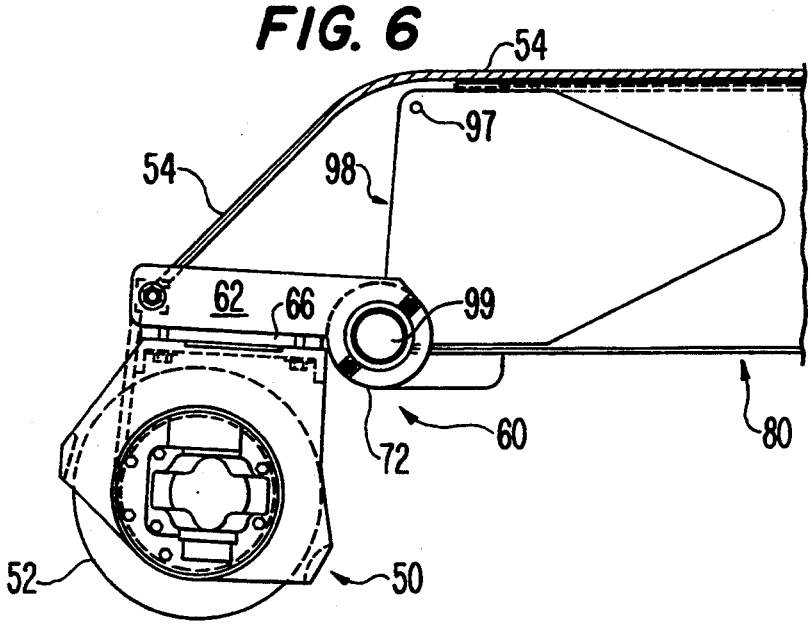
FIG. 6 is an elevation view of the hoist and hoist mount assembly of FIG. 5, shown rotated to a position allowing access to the front end of the boom.
Figure 7:
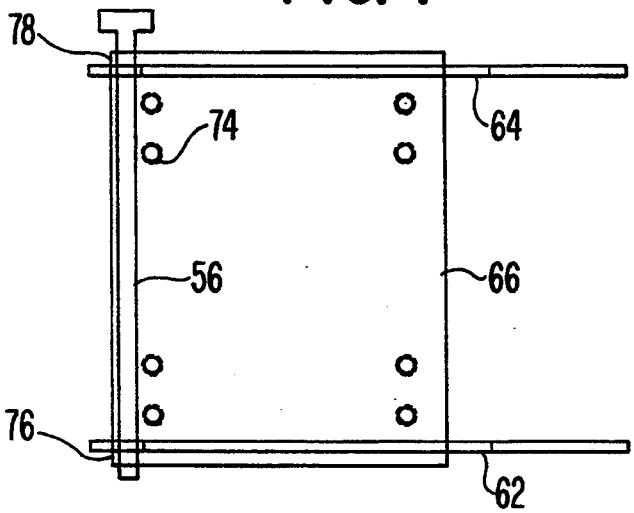
FIG. 7 is a front view of the hoist mount assembly of FIG. 5.

Referring to FIGS. 1, 2 and 3, a turntable lock assembly 32 is provided on the turntable assembly 30 to lock the turntable assembly 30 from rotation with respect to the pedestal 20 when the turntable assembly is rotated to a position in which the boom 80 extends in a position which is parallel to the longitudinal axis of the truck 14. Referring to FIGS. 2 and 3, the lock assembly 32 comprises a bushing 34 extending through a hole 36 formed in the turntable 38 of turntable assembly 30. The bushing 34 receives a pin 40 which, in the position illustrated, extends through the turntable 38 and into a hole 24 formed in the top plate 22 of the stationary pedestal 20.

The longitudinal end face of bushing 34 presents a ramped upper surface 42 having slots or grooves 44 and 46 extending radially through the ramped surface. In the illustrated embodiment, the slope of the ramped surface is 30° and the grooves 44 and 46 are separated by 180°. A handle 48 is fixed to pin 40 by welding or any other connection providing a permanent connection of the handle to the pin. A ring 49 is welded or otherwise fixed to the pin 40 proximate the end of the handle 48. A lanyard (not shown) may permanently connect the ring 48 to a point on the turntable assembly 30.

The turntable lock mechanism 32 is operable as follows:

When an operator desires to unlock the turntable 38 from the pedestal 20, he or she rotates the handle 48 in the direction of the arrow in FIG. 3 so that the handle unseats from groove 44 formed in ramped surface 42 of bushing 34 and slides up the ramped surface 42, thus raising the handle with respect to the pedestal top plate 22 and retracting the pin 40 from the pedestal top plate 22. When the handle 48 is rotated 180° from its fully inserted position, the pin 40 is fully retracted from the pedestal top plate 22. The handle can then be seated in groove 46 of the ramped surface 42, thus assuring that the pin will remain in its fully retracted position. The turntable assembly 30 can now rotate freely about the pedestal 20.

Should it be necessary to access the interior of bushing 34 for any reason, the operator can remove the pin 40 from the turntable 38 simply by grasping the ring 48 and removing the pin 40 from the bushing 34. Loss of the pin is prevented by virtue of the lanyard described above.

Should the user desire to lock the turntable in its storage position for vehicle transport, the turntable is rotated to the position illustrated in the drawings in which the bushing 34 is aligned with the hole 24 in the pedestal top plate 22. The handle 48 is then unseated from the groove 46 provided in the ramped surface 42 and is rotated 180° so that the handle slides down the ramped surface 34 to groove 44, where it is seated. During this rotation, the pin 40 is inserted into the hole 24 in pedestal top plate 22.

The provision of the turntable lock assembly 32 eliminates the need of a boom rest for locking the turntable from rotation. Moreover, by providing a rotatable handle in mating engagement with a ramped surface, the force required to retract the pin 40 from the pedestal top plate 22 is significantly decreased since considerably greater retraction forces can be imposed on the pin by converting torque on the handle 48 to linear motion of the pin than can be provided solely by pulling on the pin. In addition, by seating the handle 48 in the grooves 44 and 46 in the extreme degrees of rotation of the handle, assurance can be made that the pin will remain in either its fully extended of fully retracted position.

Of course, the turntable lock need not take the specific configuration illustrated in the drawings. For instance, the ramped surface could have a slope of greater or lesser than 30°, and the spacing between the grooves 44 and 46 could be considerably less than 180°. In addition, the pin need not extend vertically into the turntable as illustrated but could extend horizontally into the side of the turntable and engage some other engagement mechanism associated with the stationary pedestal, such as a gear. Moreover, the grooves 44 and 46 could be replaced by clasps or any other devices tending to hold the handle 48 in the desired position.

Referring again to FIGS. 2 and 4, the boom 80 is pivotally attached to the turntable assembly 30 via a pivot point 31. The piston 102 of the piston and cylinder device 100 is slidably received in a lift cylinder 104 and is pivotally connected to opposed lateral plates 84 and 85 of boom 80 via a pivot pin 86 cooperating with a pin boss 88 of boom 80. The lift cylinder 104 is, in turn, pivotally connected to turntable assembly 30 via a pivot pin 106. The piston and cylinder device 100 is hydraulically actuated by conventional hydraulic lines (not shown) to retract and extend the piston 102 into and out of the lift cylinder 104, thus raising and lowering the boom 80 with respect to the turntable assembly 30.

In order to prevent excessive forces from being imposed on the piston 102 during transport of the crane assembly, a boom rest assembly 120 can be employed to support the boom 80 on the lift cylinder 104, thereby relieving pressures on piston 102.

Figure 4:
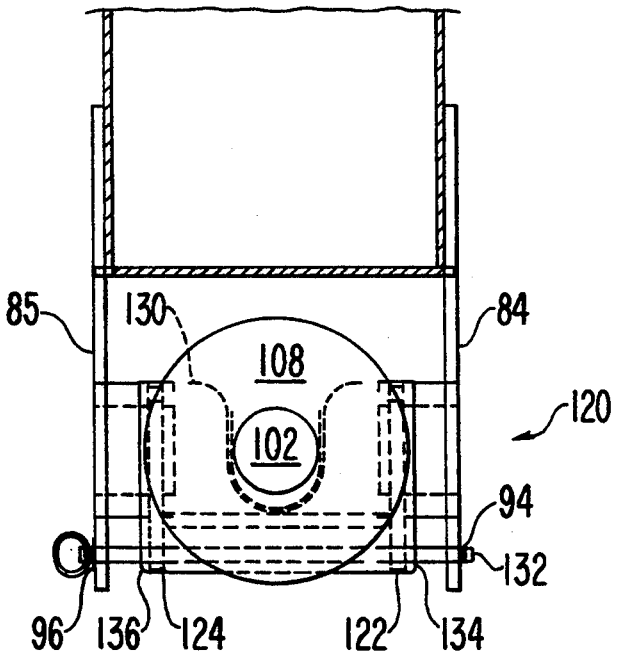
FIG. 4 is a view taken along the line 4—4 in FIG. 2.

More specifically, referring to FIGS. 2 and 4, the boom rest assembly 120 is preferably composed of a steel weldment or a formed casting. "Weldment" in the disclosed context means that the assembly is formed by welding together the individual components of the assembly. The boom rest 120 includes a pair of lateral side plates 122 and 124, each of which includes a relatively flat front surface and an arcuate rear surface 126 which presents a collar for engagement with the pin boss 88 of boom 80. The front surfaces of plates 122 and 124 are interconnected by a plate 130 which is shaped so as to at least partially surround piston 102 when the boom rest 120 is in the support position illustrated in solid lines in FIG. 2, while providing sufficient clearance between piston 102 and plate 130 to allow unobstructed movement of the piston 102 relative to the plate 130. Each of the side plates 122 and 124 is pivotally connected to the respective one of the plates 84, 85 of boom 80 at a pivot point such as pivot point 129 in FIG. 2. This pivotal connection allows the boom rest assembly to be pivoted into and out of the boom storage position illustrated in solid lines in FIGS. 2 and 4 in which the plates 122, 124 extend generally in parallel with piston 102 and the boom rest 120 securely supports the pin boss 88 of the boom on the cap 108 of the lift cylinder 104.

The boom rest assembly operates as follows:

To prepare the boom for storage, it is elevated to a position above its horizontal position. At this time, the boom rest assembly 120 is held in the position shown in broken lines in FIG. 2 in which the assembly is pivoted away from the lift cylinder 104 and thus cannot interfere with movement of the piston 102 with respect to the lift cylinder 104. The boom rest assembly 120 is held in this position by a pin 132 extending through holes 92 in plates 84 and 85 and through mating holes 134 and 136 formed in the plates 122 and 124.

The pin 132 is then removed and the assembly 120 is pivoted about pivot point 129 to a position in which the surface 126 of each of plates 122 and 124 rests against the pin boss 88 of boom support plate 84, in which the piston 102 is at least partially surrounded by plate 130, and in which the holes 134 and 136 in plates 122 and 124 are aligned with corresponding holes 94 and 96 in plates 84 and 85. The pin 132 is then inserted through the holes 94, 96, 134, and 136 to lock the assembly 120 in position. At this time, boom 80 is lowered to its horizontal position so that the plate 130 rests on the end cap 108 of lift cylinder 104, thus supporting the boom 80 on the lift cylinder 104 and relieving the pressure on piston 102. Since the compressive forces on the piston 102 are now minimal, the crane assembly can be safely transported without fear of imposing excessive compressive forces on the piston and cylinder device 100.

After transport, the boom 80 is raised slightly via actuation of the piston and cylinder device 100 to take the pressure off boom rest assembly 120. Then, the pin 132 is withdrawn from the holes 94 and 96 in the plates 84 and 85, and the assembly 120 is pivoted back to its initial position and secured in that position by inserting the pin 132 through the holes 92 of the boom 80 and the holes 134 and 136 of the plates 122 and 124 of the boom rest 120. Since the assembly 120 is now incapable of obstructing movement of the boom 80, the boom can now be lowered to a position below the horizontal position.

Of course, the boom rest assembly need not be constructed precisely as illustrated. For instance, the plates 122, 124 and 130 could be replaced with any other elements which, when the boom rest assembly is in its operative position illustrated in FIG. 2, are positionable so as to allow unobstructed movement of the piston rod 102 within the boom rest assembly and which support the boom 80 on the cylinder 104 and take the pressure off from piston 102 when the boom is lowered to a predetermined position. In addition, it is not essential that the boom rest be pivotable with respect to the boom in the manner illustrated. However, it is preferable that the boom rest be permanently connected to either the boom 80 or the lift cylinder 104, that it be moveable into and out of the boom storage position, that it be easily securable into its storage and non-storage positions, and that it provide stable support for the boom.

The boom rest assembly 120, in combination with the turntable lock assembly 32, allows for the elimination of the cradle rest provided on the trucks on which conventional crane assemblies are mounted. This in turn significantly enhances the storage area of the trucks.

Referring now to FIGS. 1 and 5–7, the hoist 50 is conventional and includes a rotating drum 52 operable to play-out and reel-in a cable 54 to raise and lower hook block or down haul weight 140. Suitable motors, brakes, etc. are provided for actuating the drum 52. The hoist 50 is securely fastened to hoist mount assembly 60, which is in turn pivotally connected to boom 80.

The hoist mount assembly 60 allows the hoist 50 to pivot itself about the end 98 of boom 80 upon rotation of drum 52 or retraction of the boom telescope function without requiring any external lifting device, thus providing access to the internal components of the end 98 of the boom 80 for maintenance, inspection, etc. The hoist mount assembly comprises first and second arm members 62 and 64 which are interconnected by a flat plate 66. The lower end of each of the arm members 62, 64 forms a half circle for mating engagement with a boss 99 extending laterally through the end 98 of boom 80. A pair of semi-circular locking plates 72 are also provided, each of which surrounds the remainder of the boss 99 and is connected to the respective arm 62, 64 so as to allow the hoist 50 and mounting assembly 60 to pivot freely about the boss 99 of boom 80. The plate 66 is securely fastened to the hoist 60 at a plurality of mounting locations 74. A connecting pin or bolt 56 is insertable through holes 97 formed in the end 98 of boom 80 and engages mating holes 76 and 78 formed in arms 62 and 64 of mounting assembly 60. Alternatively, bolts, nuts, spacers, and washers could be provided to connect each arm 62, 64 to the respective sides of the boom 80. Any other suitable releasable fasteners could also be used for this purpose.

In operation, the hoist 50 is pivoted away from the end 98 of the boom 80 in the following manner:

First, the hoist is actuated to reel in the cable 54 to a position in which the hook block or down haul weight 140 is in tight engagement with the tie down bar 142 at the rear of the truck bed 12 and all slack is removed from the cable 54, thus removing pressure from pin or bolt 56. The pin 56 is then withdrawn from the holes 76, 78, and 97. Then, the drum 52 of hoist 50 is rotated to reel-out cable, or, alternatively, the telescoping end 82 of the boom 80 is retracted to shorten the length of the boom. In either case, slack is created in the cable to allow the hoist 50 to pivot from the position illustrated in FIG. 5 to the position illustrated in FIG. 6, thereby providing access to the interior 98 of boom 80 for maintenance, inspection, etc. When the repair, maintenance, or inspection operation has been completed, the drum 52 is rotated in the opposite direction to reel the cable 54 back in, or the telescoping end 82 of the boom is again extended to lengthen the boom 80, thus taking up the slack in the cable and pivoting the hoist 50 and hoist mount assembly 60 back into the position illustrated in FIG. 5. Then, the pin or bolt 56 is reinserted and latched in position. The hoist 50 is now secured in its normal operating position.

By employing the mounting assembly 60, the illustrated assembly allows for automatic movement of the hoist 50 into and out of the working position, thus facilitating access to the interior of the boom 80 and obviating the need for an external lifting apparatus to remove the hoist. The mounting assembly 60 is preferably a steel weldment but could be a single casting or a plurality of members fastened together in any suitable manner. The assembly need not take the particular shape illustrated in the drawings but could comprise any device which is permanently connected to the hoist 50 and which is releasable to allow the hoist to move itself and the assembly with respect to the boom 80. For, example, the hoist and hoist mount could be slidably mounted on the boom 80 and could slide up and down with respect to the boom 80 upon actuation of the hoist or upon telescoping of the boom in order to provide access to the interior of the boom.

What is claimed is:

1. A crane comprising:

(a) a base;

(b) a boom which is attached to said base and which is vertically pivotable with respect to said base;

(c) a piston-cylinder device comprising a lift cylinder and a piston slidably received in said lift cylinder, said piston having an outer end connected to said boom for raising and lowering said boom with respect to said base, (d) a boom rest for supporting said boom in a stowed position during transport of the crane and preventing excessive forces being imposed on said piston during such transport, said boom rest including first means adapted to contact said boom and second means engagable with said cylinder, said boom rest being movable between a first position in which said first means and second means are out of contact with said boom and said cylinder, respectively, and a second position in which said second means engages said cylinder and said first means is engaged by said boom, the weight of said boom thereby being transferred through said boom rest to said cylinder thereby relieving the pressure on said piston, and (e) means for maintaining said boom rest in said first and second positions.

2. The crane according to claim 1, wherein said second end of said boom rest is formed with an opening slightly larger than a dimension of said piston whereby when said boom rest is in its second position, the piston has sufficient clearance to allow unobstructed movement of said piston with respect to said boom rest.

3. The crane according to claim 1, wherein said boom rest includes side plates and a connecting plate interconnecting said side plates, said connecting plate forming said second means of said boom rest engagable with said cylinder, said first means of said boom rest adapted to contact said boom comprising arcuate end surfaces formed on the ends of said side plates opposite said connecting plate, said arcuate surfaces engaging said boom when said boom is moved to the stowed position.

4. The crane of claim 3 wherein said boom has a support surface in the form of pin bosses supporting a pin operably connected to said piston, said pin bosses engaging said arcuate surfaces formed on said end surfaces of said boom rest when said boom is moved to a stowed position.

5. The crane according to claim 1, wherein said lift cylinder has an end cap for supporting said second means of said boom rest, and said boom has a support surface engaging said first means of said boom rest when said boom is in a stowed position, and wherein said first means and second means of said boom rest have shapes which generally correspond to those of said support surface of said lift cylinder and said support surface of said boom, respectively.

6. The crane of claim 3, wherein said boom includes a pair of opposed lateral plates to which said piston is pivotally attached, and wherein said side plates are pivotally connected to said opposed lateral plates and dimensioned to rotate within said lateral plates when said boom rest is moved to its second, stowed position, and wherein said arcuate end surfaces of said side plates are engaged by pin bosses mounted on said lateral plates when said boom is stowed by moving said boom rest to its second position.

7. The crane of claim 6, wherein said means for maintaining said boom rest in said first and second positions includes spaced openings formed in each of said opposed lateral plates to form opposed pairs of openings, and an opening formed in each of said side plates of said boom rest, said openings in said side plates being aligned with a first pair of openings when said boom rest is in a stowed position and being aligned with a second pair of aligned openings when said boom rest is moved away from said stowed position, and pin means extending through said aligned openings in both positions of said boom rest to maintain the same in its stowed or non-stowed position.

* * * * *